US006709376B2

(12) United States Patent
Nanba et al.

(10) Patent No.: US 6,709,376 B2
(45) Date of Patent: Mar. 23, 2004

(54) JAW CYLINDER IN JAW FOLDER

(75) Inventors: Takeo Nanba, Kanagawa (JP); Tomonari Nakajima, Kanagawa (JP); Hiroyuki Fujinuma, Tokyo (JP); Toshio Hasegawa, Kanagawa (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 0 days.

(21) Appl. No.: 10/234,360

(22) Filed: Sep. 4, 2002

(65) Prior Publication Data

US 2003/0121426 A1 Jul. 3, 2003

(30) Foreign Application Priority Data

Dec. 28, 2001 (JP) ..... 2001-401401

(51) Int. Cl.[7] ..... B31B 49/00

(52) U.S. Cl. ..... 493/475; 493/424; 493/471; 493/432; 493/476

(58) Field of Search ..... 493/359, 357, 493/424, 471, 432, 476, 428, 360, 475

(56) References Cited

U.S. PATENT DOCUMENTS 5,429,578 A * 7/1995 Calbrix et al. ..... 493/359
5,507,714 A * 4/1996 Furuta et al. ..... 493/475
5,571,069 A * 11/1996 Shah ..... 493/357
5,676,630 A * 10/1997 Mayr ..... 493/424
6,283,906 B1 * 9/2001 Kostiza ..... 493/424
6,514,188 B2 * 2/2003 Kostiza ..... 493/424

FOREIGN PATENT DOCUMENTS

| | | |
|---|---|---|
| JP | 02182668 | 7/1990 |
| JP | 04223973 | 8/1992 |
| JP | 07267488 | 10/1995 |
| JP | 08301516 | 11/1996 |

* cited by examiner

*Primary Examiner*—Mickey Yu
*Assistant Examiner*—Sameh Tawfik
(74) *Attorney, Agent, or Firm*—Trexler, Bushnell, Giangiorgi, Blackstone & Marr, Ltd.

(57) ABSTRACT

A jaw cylinder in a jaw folder is provided. A first base (1) includes a stationary member (11) in a jaw mechanism. A second base (2) includes a swing member (21) having a jaw portion accessible to the jaw portion of the stationary member (11). A third base (3) has end axes (31*a*, 31*b*) at both ends and is rotatably supported by the end axes (31*a*, 31*b*) on a pair of opposite frames (Fa, Fb). The first (1) and second (2) bases are rotatably located on the third base (3) about the rotational centerline of the third base (3) relative to the third base (3). The first (1), second (2) and third (3) bases synchronously rotate to move the swing member (21) close to and apart from the stationary member (11) to grip a print therebetween. A jaw clearance adjusting mechanism (4) turns the first (1) and second (2) bases about the rotational centerline of the third base (3) in opposite directions to adjust a gap between the jaw portions of the stationary (11) and swing (21) members in the jaw mechanism.

10 Claims, 8 Drawing Sheets

JAW CYLINDER IN JAW FOLDER

CROSS-REFERENCE TO RELATED APPLICATION

This application is based upon and claims the benefit of priority from the prior Japanese Patent Application No. 2001-401401, filed on Dec. 28, 2001, the entire contents of which are incorporated herein by reference.

BACKGROUND OF THE INVENTION

1. Field of the Invention

The present invention relates to a jaw cylinder in a jaw folder for a rotary press. In particular, it relates to a jaw cylinder in a jaw folder, which is possible to adjust a gap between a stationary (non-open/close) member and a swing (open/close) member in a jaw mechanism during operation.

2. Description of the Related Art

Publicly known jaw cylinders capable of adjusting a gap between a stationary member and a swing member in a jaw mechanism during operation include those disclosed in Japanese Patent Publication No. 7-55761 and Japanese Patent Nos. 2637067, 2779140 and 2848982, for example.

JP 7-55761 describes a jaw cylinder equipped with an adjustment mechanism capable of adjusting a gap between a stationary member and a swing member in a jaw mechanism based on a result obtained from on-machine measurement of a thickness of a web to be processed. This jaw cylinder has a jaw cylinder shaft rotatably supported on two opposite frames. A first member provided with the stationary member in the jaw mechanism and a second member provided with the swing member in the jaw mechanism are attached to the jaw cylinder shaft rotatably about the rotational centerline thereof. The jaw cylinder shaft further includes a first, a second and a third adjustment shafts. The first adjustment shaft is possible to rotate in synchronization with the jaw cylinder shaft. The first adjustment shaft has the rotational centerline coincident with the rotational centerline of the jaw cylinder shaft. The second adjustment shaft is possible to rotate about the second rotational centerline that is perpendicular to the rotational centerline of the jaw cylinder shaft and extends in the radial direction of the jaw cylinder. The second adjustment shaft is linked through a bevel gear to the first adjustment shaft to receive rotations therefrom. The third adjustment shaft is possible to rotate about the third rotational centerline that is perpendicular to the rotational center line of the jaw cylinder and to the second rotational centerline. The third adjustment shaft is linked through a bevel gear to the second adjustment shaft to receive rotations therefrom. The third adjustment shaft has one end screwed into a female threaded member attached to the first member and the other end screwed into a female threaded member attached to the second member. The jaw cylinder shaft and the first and second members are configured to rotate synchronously. On the basis of the above measured result, it rotates the first adjustment shaft relative to the jaw cylinder shaft, then rotates the third adjustment shaft through the second adjustment shaft, and turns the first and second members oppositely about the rotational centerline of the jaw shaft. The gap between the stationary and swing members in the jaw mechanism can be adjusted by widening/narrowing the gap by an equivalent amount oppositely from the location of a blade for inserting a print therebetween.

JP 263067 describes a jaw cylinder equipped with an adjustment mechanism capable of adjusting a gap between a stationary member and a swing member in a jaw mechanism. This jaw cylinder has a jaw cylinder shaft rotatably supported on two opposite frames. A first member provided with the stationary member in the jaw mechanism and a second member provided with the swing member in the jaw mechanism are attached to the jaw cylinder shaft rotatably about the rotational centerline thereof. The jaw cylinder shaft also includes an adjustment shaft that is rotatable around the same rotational centerline as the jaw cylinder shaft synchronously therewith and movable along the rotational centerline of the jaw cylinder shaft. The adjustment shaft has a groove tilted to the moving direction thereof. The jaw cylinder shaft further includes an adjustment arm that has one end linked to the groove and is movable in the direction perpendicular to the rotational centerline and in the radial direction of the jaw cylinder. On the other end of the adjustment arm, two axially symmetric slopes are arranged in parallel with the rotational centerline and equally tilted to the moving direction of the arm. One of the slopes is formed in contact with the first member and the other the second member. This adjusting mechanism allows the jaw cylinder shaft and the first and second members to rotate synchronously. A male threaded member is coupled through a bearing to the adjustment shaft on the same rotational centerline and is screwed into a female screw secured on a frame. When the male threaded member is rotationally operated to move the adjustment shaft along the rotational centerline, the adjustment arm is displaced in the radial direction. The two axially symmetric slopes on the adjustment arm are employed to turn the first and second members, which contact respectively with the two slopes, oppositely about the rotational centerline of the jaw shaft. The gap between the stationary and swing members in the jaw mechanism can be adjusted by widening/narrowing the gap by an equivalent amount oppositely from the location of a blade for inserting a print therebetween.

JP 2779140 describes a jaw cylinder equipped with an adjustment mechanism capable of adjusting a gap between a stationary member and a swing member in a jaw mechanism. This jaw cylinder has a jaw cylinder shaft rotatably supported on two opposite frames. A first member provided with the stationary member in the jaw mechanism is attached to the jaw cylinder shaft rotatably about the rotational centerline thereof. A second member provided with the swing member in the jaw mechanism is attached to an eccentric location on the first member. A gear mechanism is provided to transmit rotations from the jaw cylinder shaft to the first member so as to rotate the first member in synchronization with the jaw cylinder shaft. The torsion of a helical gear in the gear mechanism is employed to turn the first member relative to the jaw cylinder shaft about the rotational centerline of the jaw cylinder shaft. The angular displacement of the first member is transmitted to the second member through another gear or link mechanism. The second member is turned relative to the first member in the direction opposite to the direction of the angular displacement of the first member to move the swing member close to and apart from the stationary member. This arrangement is operative to turn the first member relative to the jaw cylinder shaft and turn the second member relative to the first member. The gap between the stationary and swing members in the jaw mechanism can be adjusted by widening/narrowing the gap by an equivalent amount oppositely from the location of a blade for inserting a print therebetween.

JP 2848982 describes a jaw cylinder equipped with an adjusting mechanism capable of adjusting a gap between a stationary member and a swing member in the jaw mechanism. This jaw cylinder has a jaw cylinder shaft rotatably supported on two opposite frames. A first member provided with the stationary member in the jaw mechanism and a second member provided with a swing member in the jaw mechanism are attached to the jaw cylinder shaft rotatably about the rotational centerline thereof. A transmission gear is interposed between the first and second members to rotate about the rotational centerline of the jaw cylinder shaft and mated with a gear located on the jaw cylinder shaft to rotate integrally with the jaw cylinder shaft. When the transmission gear rotates together with the jaw cylinder shaft, the first and second members rotate together. When the transmission gear turns relative to the jaw cylinder shaft using the torsion of the helical gear, the first and second members turn oppositely to move the swing member close to and apart from the stationary member. Alternatively, so as to rotate the first and second members in synchronization with the jaw cylinder shaft, the torsion of the helical gear in the gear mechanism for transmitting rotations from the jaw cylinder shaft to the first and second members can be employed. The first and second members turn about the rotational centerline of the jaw cylinder shaft oppositely to move the swing member close to and apart from the stationary member. This arrangement is operative to turn the first and second members relative to the jaw cylinder shaft. The gap between the stationary and swing members in the jaw mechanism can be adjusted by widening/narrowing the gap by an equivalent amount oppositely from the location of a blade for inserting a print therebetween.

The above-described conventional jaw cylinders have common subjects to be solved. In movable linkers and couplers, that is, in gear-mating sections, coupling sections between male and female screws, and movable fitting sections, among members employed to form the mechanism for adjusting the gap between the stationary and swing members, fine clearances provided for movement are integrated in an unstable condition. An adjusted amount of the clearance varies within a range summing these fine clearances, lacking accuracy and exhibiting extreme ambiguity. It is therefore difficult to correctly set the gap between the jaw portions of the stationary and swing members. Accordingly, if the jaw is too weak, a print is dropped off, causing paper jamming in the jaw folder and disturbing a paper rejection pitch that is originally constant. This is a disadvantage. In contrast, if the jaw is too strong, a print is broken, causing an obvious offset in images printed on adjacent pages. This is another disadvantage. In particular, a thin print to be gripped increases this trend.

SUMMARY OF THE INVENTION

The present invention has an object to provide a jaw cylinder in a jaw folder, which can correctly adjust a gap between a stationary member and a swing member in a jaw mechanism in accordance with a thickness of a print to be processed.

To achieve the above object, the present invention provides a jaw cylinder in a jaw folder, comprising: a first base including a stationary member in a jaw mechanism, said stationary member having a jaw portion; a second base including a swing member, said swing member having a jaw portion accessible to said jaw portion of said stationary member; and a third base having end axes at both ends, said third base rotatably supported by said end axes on a pair of opposite frames, said first base and said second base rotatably located on said third base about the rotational centerline of said third base, said first, second and third bases synchronously rotating to move said swing member close to and apart from said stationary member to grip a print therebetween, said jaw cylinder further comprising: a jaw clearance adjusting mechanism for turning said first and second bases about the rotational centerline of said third base in opposite directions to adjust a gap between said jaw portion of said stationary member and said jaw portion of said swing member in said jaw mechanism; a first force exerting mechanism for always exerting a force on said first base in the direction parallel with the tangent to a rotational trail of said first base; and a second force exerting mechanism for always exerting a force on said second base in the direction parallel with the tangent to a rotational trail of said second base.

In such the jaw cylinder according to the present invention, the jaw clearance adjusting mechanism is operative to turn the first base and the second base about the rotational centerline of the third base oppositely and equally. In this case, the stationary member arranged on the first base and the swing member arranged on the second base are displaced oppositely about the rotational centerline of the third base. As a result, the gap between the jaw portions of the stationary and swing members can be adjustably varied. At this moment, the first force exerting mechanism and the second force exerting mechanism always exert forces on the first base and the second base in the direction parallel with the tangent to the rotational trails. Therefore, a movable section in the jaw clearance adjusting mechanism is always pressed against one of corresponding sections by a fine clearance. Such the fine clearances, for movement in the circumferential direction about the rotational centerline of the third base or the direction of the gap between the jaw portions of the stationary member and swing member, are integrated always in one direction. Therefore, the fine clearances are not integrated in an unstable condition during the adjusting operation and an amount of adjustment does not lack accuracy.

In the jaw cylinder according to the present invention, preferably, the forces exerted from the first force exerting mechanism and the second force exerting mechanism direct oppositely. Preferably, the first force exerting mechanism and the second force exerting mechanism are arranged on the third base. Preferably, the first force exerting mechanism and the second force exerting mechanism are integrated and interposed between the first base and the second base.

In the jaw cylinder according to the present invention, preferably, the jaw clearance adjusting mechanism including: a first camshaft rotatably supported on said third base, and having a first eccentric cam located at a portion corresponding to said first base and a first gear located at a portion protruded from a side of said jaw cylinder to one of said frames; a second camshaft rotatably supported on said third base, and having a second eccentric cam located at a portion corresponding to said second base and a second gear located at a portion protruded from a side of said jaw cylinder to said one of said frames; a first slider fitted with said first eccentric cam and arranged on said first base only movable in the radial direction of said first base; a second slider fitted with said second eccentric cam and arranged on said second base only movable in the radial direction of said second base; a follower gear attached to a portion of said end axis of said third base protruded from said one of said frames and mated with a driver gear to transmit rotations to said third base; a gear mechanism rotatably supported on said one of said frames about the rotational centerline of said third base, and having a fourth gear located at a portion protruded to one side of said one of said frames and a third gear located at a portion protruded to the other side of said one of said frames, said third gear mating with said first gear and said second gear simultaneously; a transmission gear mechanism having a fifth gear mating with said follower gear and a sixth gear mating with said fourth gear, said fifth and sixth gears located integrally and rotatably about the same rotational centerline and movable in the direction parallel with the rotational centerline, at least one of said fifth and sixth gears and a gear mating therewith consisting of helical gears; and an adjusting mechanism for displacing said transmission gear mechanism in the direction parallel with said rotational centerline thereof.

In such the arrangement, the jaw clearance adjustment mechanism operates in the following manner. The adjustment mechanism is operative to move the transmission gear mechanism in parallel with the rotational centerline thereof. Among the helical gears in the transmission gear mechanism and the helical gears mating therewith, one at downstream of the drive transmission turns about its own rotational centerline due to the teeth torsion of another at upstream. Through the fifth gear and the sixth gear at downstream of the follower gear, the fourth gear at further downstream turns about its own rotational centerline (the same rotational centerline as those of three bases). When the fourth gear turns, the third gear integrally provided with the fourth gear turns, the first gear and the second gear mating with the third gear turn simultaneously, and the first camshaft and the second camshaft turn relative to the third base. When the first camshaft turns, the first eccentric cam located on this shaft turns within the first slider fitted with this cam to move the first slider in the radial direction of the first base. It also imparts a force to the first base through the first slider in one direction parallel with the tangent to the rotational trail thereof. In response to this force, the first base turns about its own rotational centerline (the same rotational centerline as that of the third base) in one direction. When the second camshaft turns, the second eccentric cam located on this shaft turns within the second slider fitted with this cam to move the second slider in the radial direction of the second base. It also exerts a force to the second base through the second slider in a direction parallel with the tangent to the rotational trail thereof and opposite to the direction of the force exerted to the first base. In response to this force, the second base turns about its own rotational centerline (the same rotational centerline as that of the third base) in a direction opposite to the direction of the first base. Accordingly, the stationary member located on the first base and the swing member located on the second base are forced to displace oppositely about the rotational centerline of the third base to adjust the gap between jaw portions of both members.

Also in this arrangement, the first force exerting mechanism and the second force exerting mechanism always exert opposite forces onto the first base and the second base. In this case, a movable section in the jaw clearance adjustment mechanism is always pushed against one of corresponding sections by a fine clearance. As a result, fine clearances for movement in the circumferential direction about the rotational centerline of the third base or in the direction of the gap between the jaw portions of the stationary member and the swing member are always integrated in one direction. Therefore, when the jaw gap is adjusted, the fine clearances are not integrated in an unstable state without lacking accuracy in an amount of adjustment.

Preferably, in the jaw cylinder according to the present invention, the jaw clearance adjusting mechanism includes a camshaft rotatably supported on said third base, and having a first eccentric cam located at a portion corresponding to said first base, a second eccentric cam located at a portion corresponding to said second base and a camshaft gear located at a portion protruded from a side of said jaw cylinder to one of said frames; a first slider fitted with said first eccentric cam and arranged on said first base only movable in the radial direction of said first base; a second slider fitted with said second eccentric cam and arranged on said second base only movable in the radial direction of said second base; a follower gear attached to a portion of said end axis of said third base protruded from said one of said frames and mated with a driver gear to transmit rotations to said third base; a gear mechanism rotatably supported on said one of said frames about the rotational centerline of said third base and having a fourth gear located at a portion protruded to one side of said one of said frames, and a third gear located at a portion protruded to the other side of said one of said frames, said third gear mating with said camshaft gear; a transmission gear mechanism having a fifth gear mating with said follower gear and a sixth gear mating with said fourth gear, said fifth and sixth gears located integrally and rotatably about the same rotational centerline and movable in the direction parallel with the rotational centerline, at least one of said fifth and sixth gears and a gear mating therewith consisting of helical gears; and an adjusting mechanism for displacing said transmission gear mechanism in the direction parallel with said rotational centerline thereof.

In this arrangement, the first eccentric cam and the second eccentric cam are located on a single camshaft. Except for this point, the jaw clearance adjusting mechanism has the same arrangement as the above arrangement. In a word, the single camshaft serves as replacement for the first camshaft and the second camshaft. Other operations are therefore similar to those of the jaw clearance adjusting mechanism in the above arrangement.

Preferably, in the jaw cylinder according to the present invention, the fifth gear and the sixth gear both consist of helical gears located at different torsion angles and/or torsion directions. In the jaw clearance adjusting mechanism thus configured, the magnitude of the displacement of the fourth gear caused from the operation of the adjusting mechanism matches a total of the displacement caused from the torsion of the fifth gear and the displacement caused from the torsion of the sixth gear. Except for this point, the jaw clearance adjusting mechanism has the same operation as that of the above-described jaw clearance adjusting mechanism.

Preferably, the jaw cylinder according to the present invention further comprises a repulsive mechanism interposed between the follower gear and the fourth gear, the repulsive mechanism always exerting a force on an eccentric location of the follower gear in one direction parallel with the tangent to the rotational trail of the follower gear, and always exerting a force on an eccentric location of the fourth gear in the direction opposite to the one direction parallel with the tangent to the rotational trail of the follower gear.

In the jaw clearance adjusting mechanism thus configured, the repulsive mechanism operates in between the follower gear and the fourth gear. To the fourth gear at downstream of the follower gear in the drive transmission, the repulsive mechanism always exerts a force in the tangent direction to the rotational trail thereof. The fourth gear turns about its own rotational centerline (similar to the rotational centerline of the follower gear) to always push one tooth surface against the corresponding tooth surface of the follower gear. In a word, free rotations caused from backlash between the follower gear and the fifth gear and backlash between the sixth gear and the fourth gear during rotations of these gears can be blocked. This is effective to prevent an unstable integration of the fine clearances corresponding to the backlash during the jaw clearance adjustment without lacking accuracy in an amount of adjustment.

BRIEF DESCRIPTION OF THE DRAWINGS

The present invention will be more fully understood from the following detailed description with reference to the accompanying drawings in which.

DETAILED DESCRIPTION OF THE PREFERRED EMBODIMENTS

Figure 1:
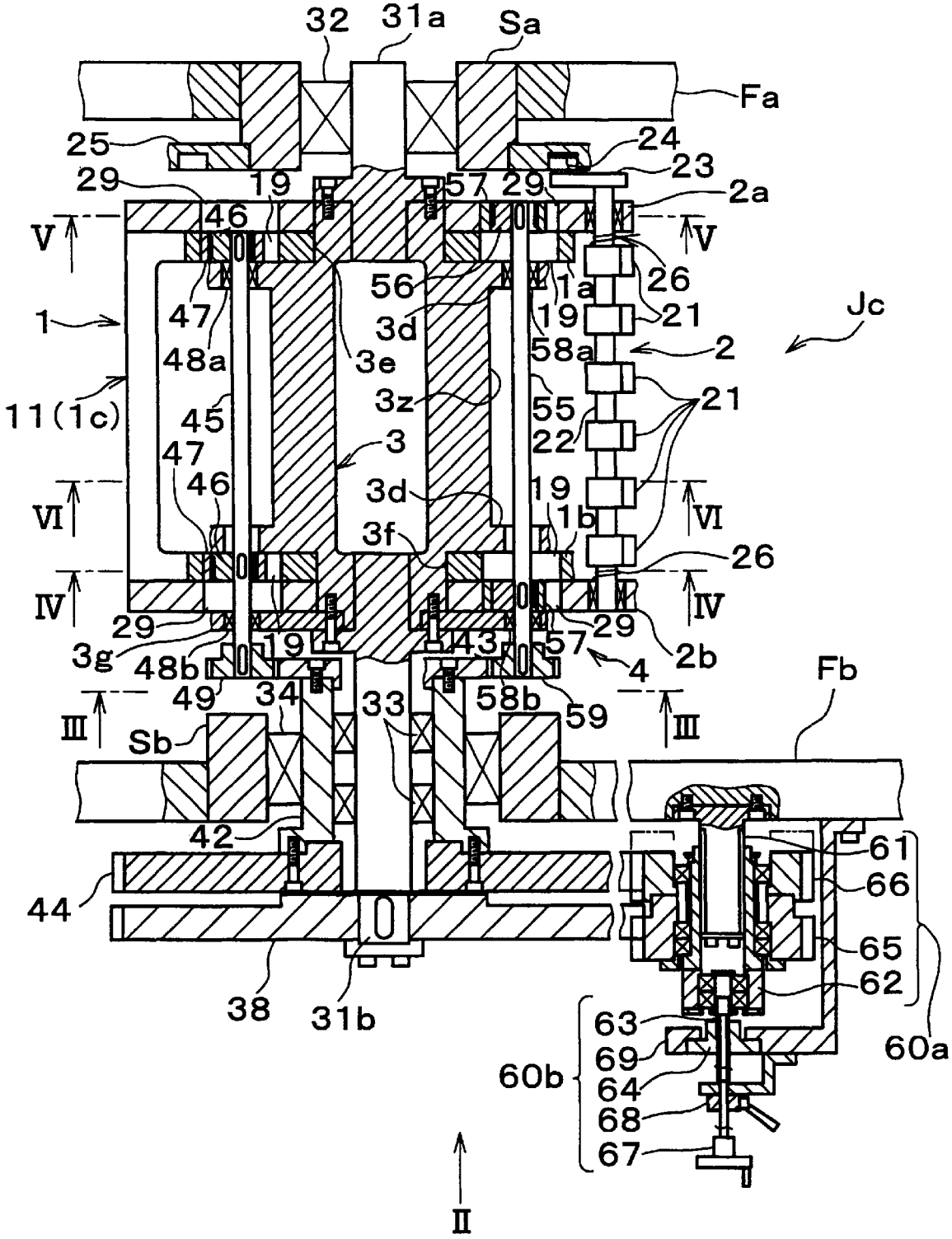
FIG. 1 is a partial cross-sectional view showing a first embodiment of a jaw cylinder in a jaw folder according to the present invention, which is a synthesis of cross-sectional views taken along the Ia—Ia and Ib—Ib lines in FIG. 2 or 3.
Figure 2:
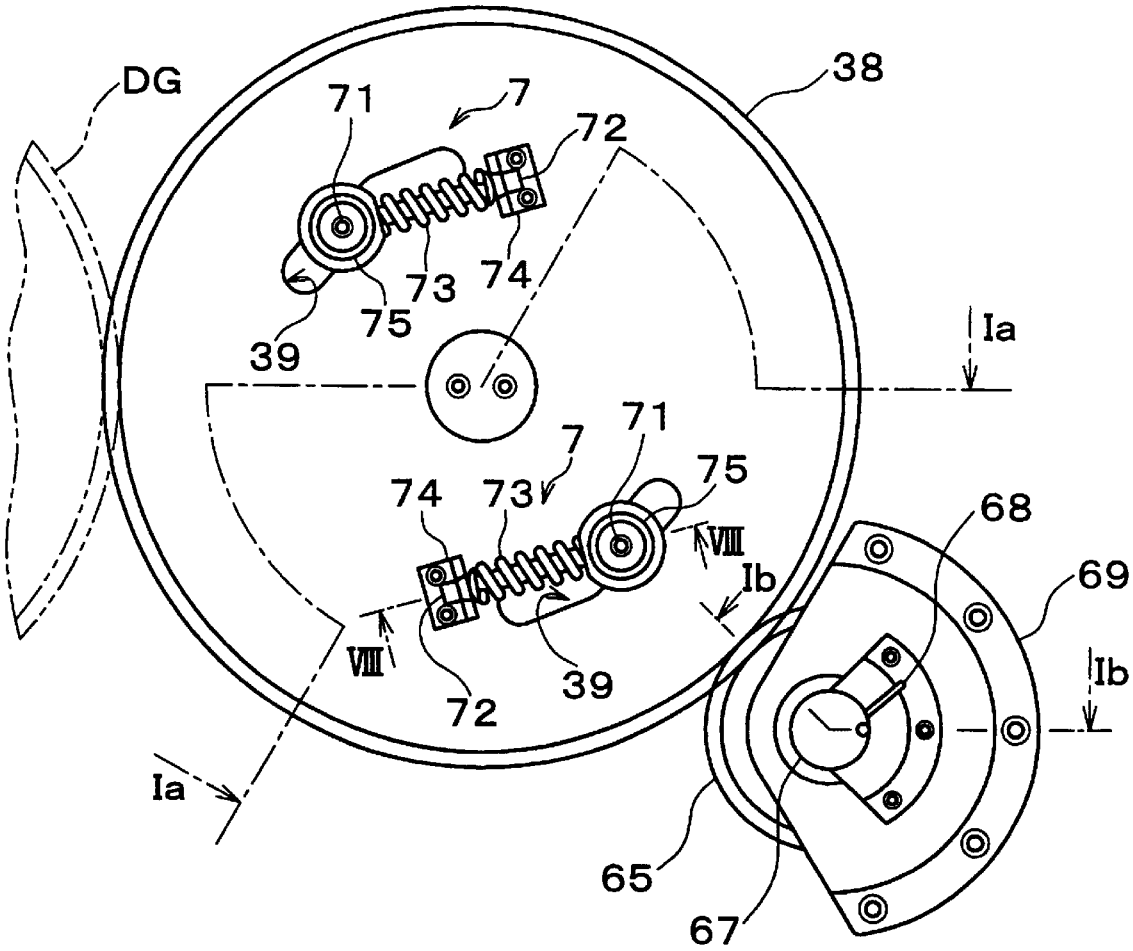
FIG. 2 is a diagram viewed in the direction of the arrow II in FIG. 1.
Figure 3:
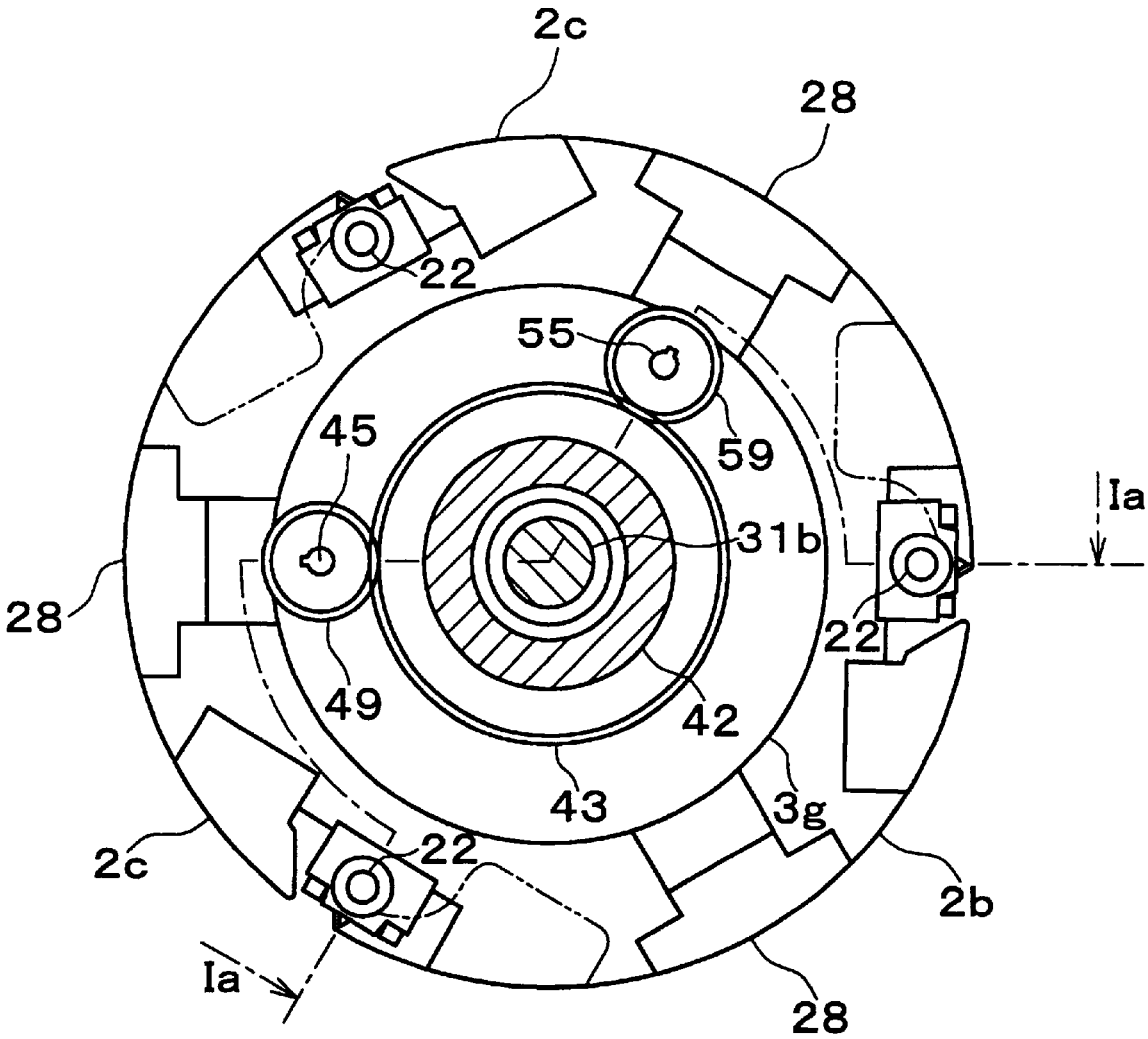
FIG. 3 is a cross-sectional view taken along the III—III line in FIG. 1.
Figure 4:
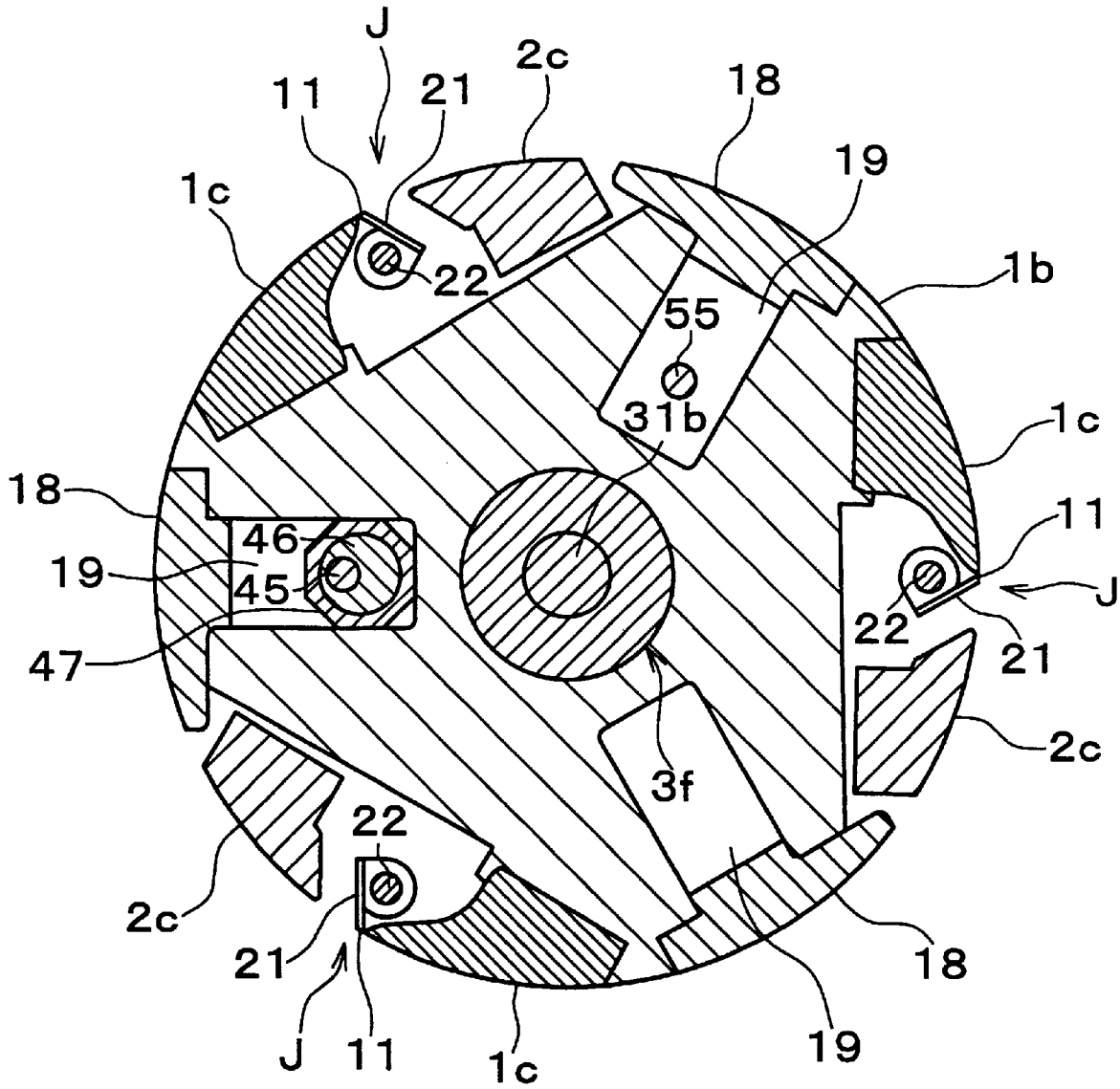
FIG. 4 is a cross-sectional view taken along the IV—IV line in FIG. 1.
Figure 5:
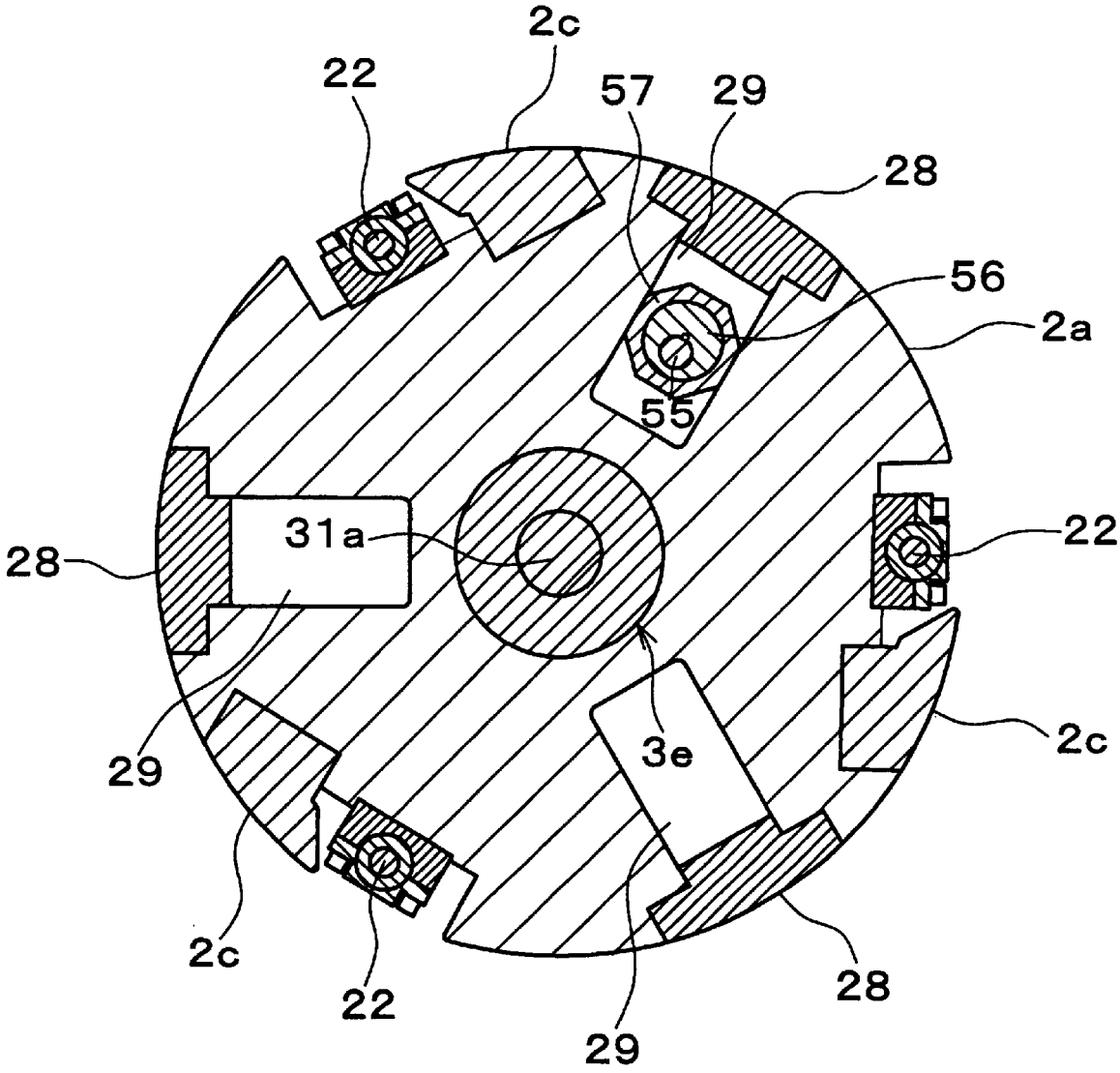
FIG. 5 is a cross-sectional view taken along the V—V line in FIG. 1.
Figure 6:
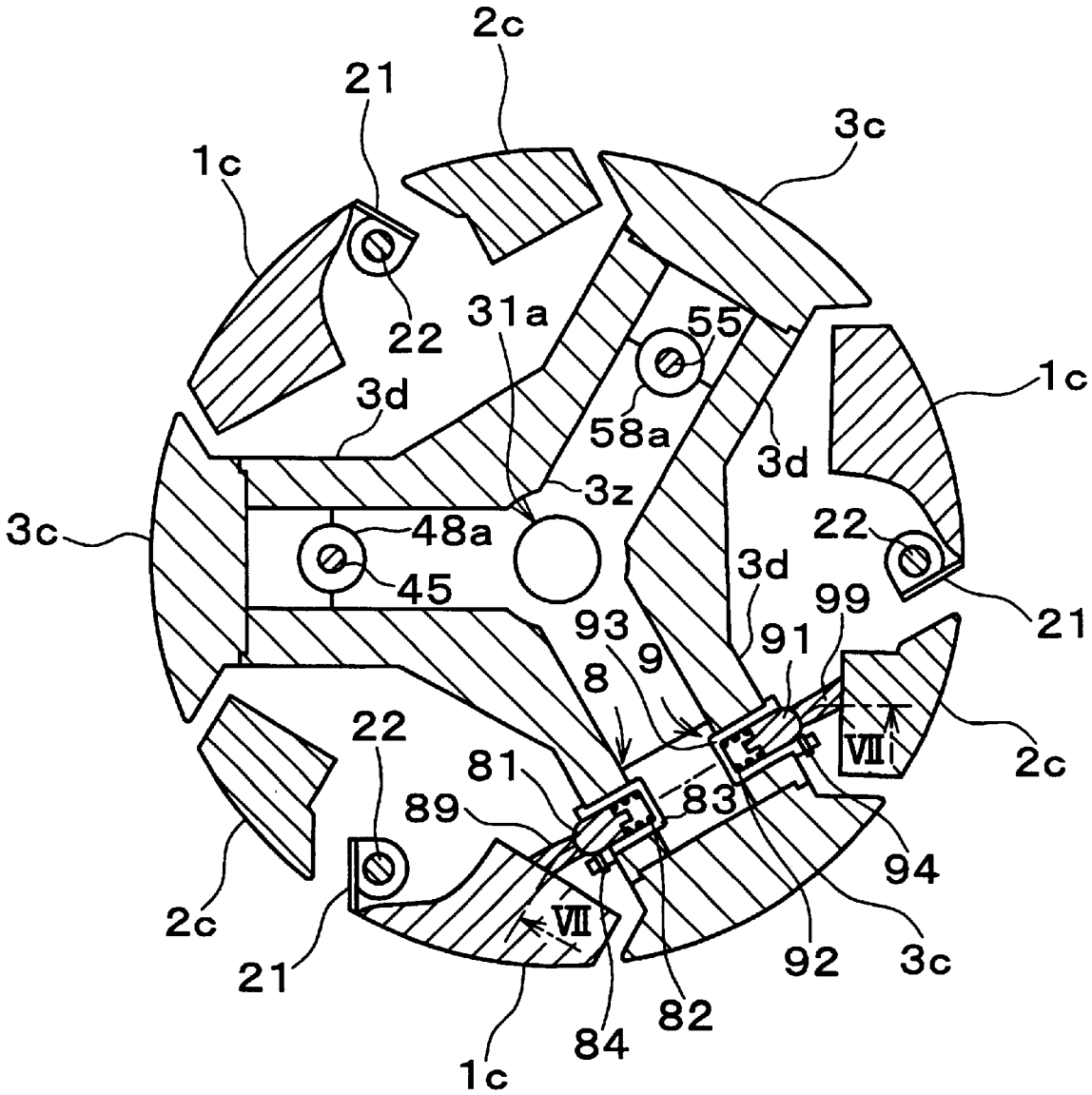
FIG. 6 is a cross-sectional view taken along the VI—VI line in FIG. 1.
Figure 7:
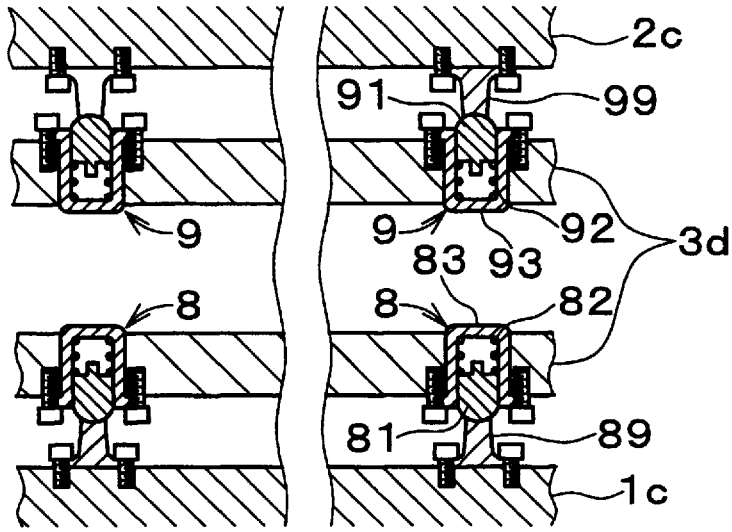
FIG. 7 is a partly omitted cross-sectional view taken along the VII—VII line in FIG. 6.
Figure 8:
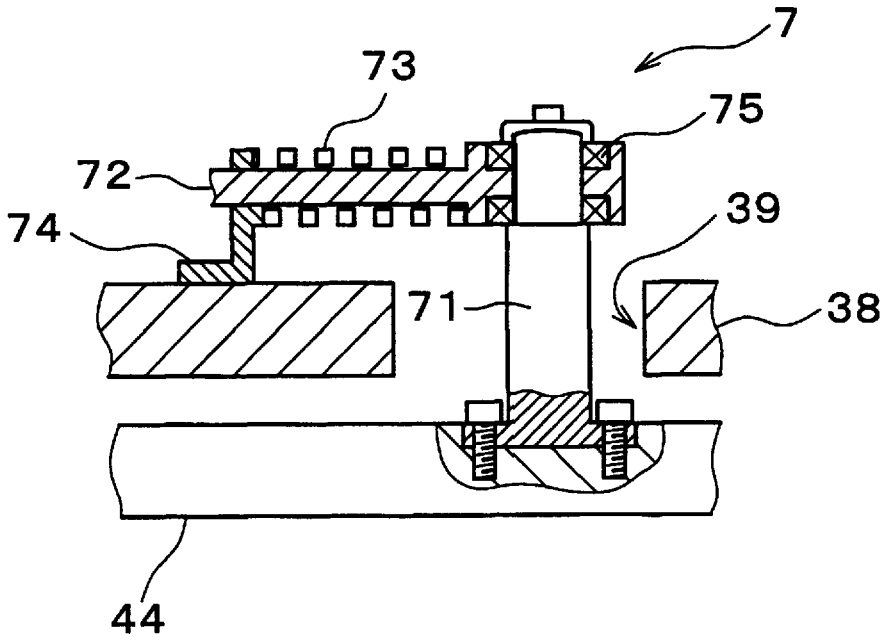
FIG. 8 is across-sectional view taken along the VIII—VIII line in FIG. 2.

A first embodiment of a jaw cylinder in a jaw folder according to the present invention will be described next based on the drawings. FIG. 1 is a partial cross-sectional view showing a jaw cylinder according to the first embodiment, which is a synthesis of cross-sectional views taken along the Ia—Ia and Ib—Ib lined in FIG. 2 or 3. FIG. 2 is a diagram viewed in the direction of the arrow II in FIG. 1. FIG. 3 is across-sectional view taken along the III—III line in FIG. 1. FIG. 4 is a cross-sectional view taken along the IV—IV line in FIG. 1. FIG. 5 is a cross-sectional view taken along the V—V line in FIG. 1. FIG. 6 is a cross-sectional view taken along the VI—VI line in FIG. 1. FIG. 7 is a partly omitted cross-sectional view taken along the VII—VII line in FIG. 6. FIG. 8 is a cross-sectional view taken along the VIII—VIII line in FIG. 2.

A jaw cylinder JC according to the first embodiment comprises a first base 1, a second base 2, a third base 3 and a jaw clearance adjusting mechanism 4.

The first base 1 comprises, as shown in FIGS. 1 and 4, a pair of first plates 1*a*, 1*b* arranged at both sides of the jaw cylinder JC, and three first stays 1*c*, 1*c*, 1*c* located in parallel with the axis of the jaw cylinder JC to link the first plates 1*a* and 1*b* together and to form a part of the outer circumference of the jaw cylinder JC. These first stays 1*c*, 1*c*, 1*c* are spaced at an equal interval in the circumferential direction about the rotational centerline of the jaw cylinder JC. The two first plates 1*a*, 1*b* are located on later-described small-diameter portions 3*e*, 3*f* in the third base 3 rotatably about the rotational centerline of the third base 3 relative to the third base 3. A stationary (non-open/close) member 11 in a jaw mechanism J is located at one side of the first stay 1*c* in parallel with the rotational centerline of the jaw cylinder JC. Notches 19, 19, 19 are formed in the first plates 1*a*, 1*b*, opened toward the outside in the radial direction of the jaw cylinder JC and spaced at an equal interval in the circumferential direction about the rotational centerline of the jaw cylinder JC. A later-described first slider 47 in the jaw clearance adjusting mechanism 4 is attached to each of these notches 19, 19, 19 movably only in the radial direction of the jaw cylinder JC. Caps 18 are employed to close the openings at the outer circumference of the notches 19, 19, 19.

The second base 21 includes, as shown in FIGS. 1 and 5, a pair of second plates 2*a*, 2*b* arranged at both sides of the jaw cylinder JC, and three second stays 2*c*, 2*c*, 2*c* located in parallel with the axis of the jaw cylinder JC to link the second plates 2*a* and 2*b* together and to form a part of the outer circumference of the jaw cylinder JC. These second stays 2*c*, 2*c*, 2*c* are spaced at an equal interval in the circumferential direction about the rotational centerline of the jaw cylinder JC. The two second plates 2*a*, 2*b* are located on later-described small-diameter portions 3*e*, 3*f* in the third base 3 rotatably about the rotational centerline of the third base 3 relative to the third base 3. Pivots 22 are rotatably supported in between the second plates 2*a* and 2*b*. Later-described swing (open/close) members 21, . . . , 21 in the jaw mechanism J are attached to the pivots 22. These pivots 22 are located three, which are spaced at an equal interval in the circumferential direction about the rotational centerline of the jaw cylinder JC. Notches 29, 29, 29 are formed in the second plates 2*a*, 2*b*, opened toward the outside in the radial direction of the jaw cylinder JC and spaced at an equal interval in the circumferential direction about the rotational centerline of the jaw cylinder JC. A later-described second slider 57 in the jaw clearance adjusting mechanism 4 is attached to each of these notches 29, 29, 29 movably only in the radial direction of the jaw cylinder JC. Caps 28 are employed to close the openings at the outer circumference of the notches 29, 29, 29.

An end of the pivot 22 (the upper side in FIG. 1) passes through the second plate 2*a* and the tip thereof is attached to one end of an arm 23 that extends at right angle from the rotational centerline of the pivot 22. The other end of the arm 23 is attached to a cam follower 24 through a pin located in parallel with the rotational centerline of the pivot 22. The cam follower 24 is inserted into a groove cam 25 fixedly provided on a sleeve Sa. When the jaw cylinder JC rotates, the cam follower 24 displaces along the groove cam 25 to turn the swing members 21, . . . , 21 through the pivots 22 at appropriate timing. Torsion springs 26, 26 are provided to exert forces on the pivots 22 to rotationally drive them always in one direction. The cam follower 24 is operative in contact with one guide surface of the groove cam 25.

The third member 3 includes, as shown in FIGS. 1 and 6, a body 3*z* having end shafts 31*a*, 31*b* at both ends coaxial with the rotational centerline of the jaw cylinder JC, small-diameter portions 31*e*, 31*f* formed at inner locations from the end shafts 31*a*, 31*b* on the body 3*z* to have diameters larger than the end shafts 31*a*, 31*b* and smaller than the body 3*z*, rising portions 3*d*, . . . , 3*d* formed at inner locations from the small-diameter portions 31*e*, 31*f* on the body 3*z*, located at an equal interval in the circumferential direction about the rotational centerline of the jaw cylinder JC and protruded in the radial direction, third stays 3*c*, 3*c*, 3*c* attached to the tips of the rising portions 3*d*, . . . , 3*d* and located in parallel with the axis of the jaw cylinder JC to form a part of the outer circumference of the jaw cylinder JC. The third member 3 is rotatably supported on opposing frames Fa, Fb located through the end shafts 31*a*, 31*b*. The end shaft 31*a* is rotatably supported on the frame Fa through a bearing 32 and the sleeve Sa. The end shaft 31*b* is rotatably supported on the frame Fb through a bearing 33, a gear mechanism sleeve 42 in the jaw clearance adjusting mechanism 4, a bearing 34 and a sleeve Sb. The small-diameter portion 3*f* is formed in a two-stage shape having a large-diameter part and a small-diameter part toward the end. The first plate 1*b* and the second plate 2*b* are rotatably attached to the large-diameter part. A holder plate 3*g* is attached to the small-diameter part. The holder plate 3*g* and the rising portions 3*d*, . . . , 3*d* located at the opposite positions are employed to rotatably support the first camshaft 45 and the second camshaft 55 relative to the third base 3 through bearings 48*a*, 58*a*, 48*b*, 58*b*. A follower gear 38 is attached to the tip of the end shaft 31*b* passed through the frame Fb to transmit the rotational drive to the jaw cylinder JC. The follower gear 38 mates with a driver gear DG as shown in FIG. 2. The follower gear 38 and the driver gear DG are both helical gears in the shown embodiment.

As shown in FIGS. 6 and 7, on the rising portion 3*d* provided neither with the first camshaft 45 nor with the second camshaft 55, a first force exerting mechanism 8 and a second force exerting mechanism 9 are located. The first force exerting mechanism 8 exerts a force to an eccentric location on the first base 1 in one direction parallel with the tangent to a rotational trail of the first base 1. The second force exerting mechanism 9 exerts a force to an eccentric location on the second base 2 in one direction parallel with the tangent to a rotational trail of the second base 2. The first force exerting mechanism 8 is located on a wall of the rising portion 3*d* opposing to the first stay 1*c*. The second force exerting mechanism 9 is located on a wall of the rising portion 3*d* opposing to the second stay 2*c*. At locations on the first force exerting mechanism 8 and the second force exerting mechanism 9, opposing to the first stay 1*c* and second stay 2*c*, pushers 81, 91 having tips directing to the first stay 1*c* and second stays 2*c* and protruded from the wall of the rising portion 3*d* are provided. A support 89 for contacting with the pusher 81 is provided on a surface of the first stay 1*c* opposing to the pusher 81. A support 99 for contacting with the pusher 91 is provided on a surface of the second stay 2*c* opposing to the pusher 91. The pusher 81 contacts with the support 89 and pushes it in one direction and the pusher 91 contacts with the support 99 and pushes it in the opposite direction.

The first force exerting mechanism 8 includes the above-described pusher 81, a case 83 and a compressible spring 82. The case 83 has an aperture opened toward the first stay 1*c*. An inwardly protruding stopper 84 is located at the edge of the aperture. The case 83 is employed for housing the pusher 81, remaining its tip protruded from the aperture. The compressible spring 82 exerts a force toward the first stay 1*c* to the pusher 81 housed in the case 83. The stopper 84 interferes with the step formed in the pusher 81 to prevent the pusher 81 from rushing out of the case 83. Similarly, the second force exerting mechanism 9 includes the above-described pusher 91, a case 93 and a compressible spring 92. The case 93 has an aperture opened toward the second stay 2*c*. An inwardly protruding stopper 94 is located at the edge of the aperture. The case 93 is employed for housing the pusher 91, remaining its tip protruded from the aperture. The compressible spring 92 exerts a force toward the second stay 2*c* to the pusher 91 housed in the case 93. The stopper 94 interferes with the step formed in the pusher 91 to prevent the pusher 91 from rushing out of the case 93.

The jaw clearance adjusting mechanism 4 includes, as described above, the first camshaft 45 rotatably supported through bearings 48*a*, 48*b* on the holder plate 3*g* and the rising portions 3*d*, . . . , 3*d* located at the opposite locations, first eccentric cams 46, 46 provided rotatably together with the first camshaft 45 at locations of the first camshaft 45 corresponding to the notches 19 in the first plates 1*a*, 1*b*, first sliders 47 rotatably fitted with the first eccentric cams 46 and mounted in the notches 19 movably only in the radial direction of the first plates 1*a*, 1*b* and a first gear 49 located rotatably together with the first camshaft 45 at the tip of the first camshaft 45 passed through the holder plate 3*g*. Similarly, the jaw clearance adjusting mechanism 4 includes, as described above, the second camshaft 55 rotatably supported through bearings 58*a*, 58*b* on the holder plate 3*g* and the rising portions 3*d*, . . . , 3*d* located at the opposite locations, second eccentric cams 56, 56 provided rotatably together with the second camshaft 55 at locations corresponding to the notches 29 in the second plates 2*a*, 2*b* of the second camshaft 55, second sliders 57 rotatably fitted with the second eccentric cams 56 and mounted in the notches 29 movably only in the radial direction of the second plates 2*a*, 2*b*, and a second gear 59 located rotatably together with the second camshaft 55 at the tip of the second camshaft 55 passed through the holder plate 3*g*. The first camshaft 45 and the second camshaft 55 are located to position their centerlines on locations apart the same distance from the rotational center of the third base 3. The first gear 49 and the second gear 59 have the same number of teeth and the same pitch circular diameter. They mate with a third gear 43 that is attached to the basic end of the gear mechanism sleeve 42 (the upper side in FIG. 1) and rotatably located together with the gear mechanism sleeve 42. When the first camshaft 45 turns through the third gear 43 and the first gear 49 and the second camshaft 55 turns through the third gear 43 and the second gear 59. The first eccentric cam 46 and second eccentric cam 56 are arranged to turn the first base 1 and second base 2 about the rotational centerline of the third base 3 by an equal angle in opposite directions. A fourth gear 44 is attached to the tip of the gear mechanism sleeve 42 (the lower side in FIG. 1) rotatably together with the gear mechanism sleeve 42. In the shown embodiment, the fourth gear 44 is a helical gear that has the same pitch circular diameter as that of the follower gear 38 and the opposite direction of torsion relative to that of the follower gear 38.

The jaw clearance adjusting mechanism 4 is further provided with a transmission gear mechanism 60*a*, which can be operated by an adjusting mechanism 60*b*. In the transmission gear mechanism 60*a*, a fifth gear 65 mating with the follower gear 38 and a sixth gear 66 mating with the fourth gear 44 can rotate together about the same rotational centerline and reciprocally move in parallel with the rotational centerline. The adjusting mechanism 60*b* can move the transmission gear mechanism 60*a* reciprocally in parallel with the rotational centerline and secure it on a finally moved location. A spline shaft 61 is arranged in parallel with the rotational centerline of the jaw cylinder JC and secured on the frame Fb. A movable sleeve 62 is attached to the spline shaft 61 movably in the axial direction. The fifth gear 65 and the sixth gear 66 are rotatably attached to the movable sleeve 62 through bearings. To the tip of the movable sleeve 62, one end of a male threaded member 63 is rotatably attached through a bearing, holding the axis coincident with the rotational centerline of the fifth gear 65 and the sixth gear 66. A male threaded portion in the male threaded member 63 is screwed into a female portion 64 on a bracket 69 located on the frame Fb, and a handle 67 is attached to the tip. The male threaded member 63 can be secured by a lock mechanism 68 for blocking a rotation thereof.

In the jaw cylinder JC according to the first embodiment, a pair of repulsive mechanisms 7 is located in between the follower gear 38 and the fourth gear 44. The repulsive mechanism 7 includes a shaft 71, as shown in FIGS. 2 and 8, of which basic portion of is attached to a surface of the fourth gear 44 opposite to the follower gear 38. The shaft 71 protrudes from the outer circumference of the follower gear 38 through the oval through hole 39 formed in the follower gear 38. The repulsive mechanism 7 also includes a guide rod 72, of which basic portion is rotatably attached through a bearing 75 to the portion of the shaft 71 protruded from the outer circumference of the follower gear 38. The repulsive mechanism 7 also includes a bracket 74 located on the outer circumference of the follower gear 38 and at a location apart a distant shorter than a length from the center of the shaft 71 to the tip of the guide rod 72. The bracket 74 allows the tip of the guide rod 72 to penetrate therethrough when the follower gear 38 mates with the fifth gear 65 and the fourth gear 44 with the sixth gear 66. The repulsive mechanism 7 also includes a compressible spring 73 elastically located along the guide rod 72 between the basic portion of the guide rod 72 and the bracket 74. The repulsive mechanism 7 is operative to use the repulsive force from the compressible spring 73 to exert forces to the follower gear 38 and the fourth gear 44 in opposite tangent directions.

According to the above arrangement, when the jaw folder is operated to rotate the jaw cylinder JC, the cam follower 24 displaces along the groove cam 25 to turn the pivot 22 through the arm 23. When the pivot 22 turns, the swing member 21 attached on the pivot 22 turns consequentially to repeatedly move the tip or the jaw portion thereof close to and apart from the jaw portion of the stationary member 11 at appropriate timing. When the swing member 21 moves closer to the stationary member 1, a print can be gripped between the jaw portions. During this operation of the jaw folder, if the gap between the jaw portions of the stationary member 11 and the swing member 21 is not suitable for a thickness of a print to be gripped, the jaw clearance adjusting mechanism 4 is operated. The jaw clearance adjusting mechanism 4 is operative to adjust the distance or the jaw clearance between the jaw portions of the stationary member 11 and the swing member 21 in the closed state.

The jaw clearance can be adjusted when the male threaded member 63 locked by the lock mechanism 68 in the jaw clearance adjusting mechanism 4 is unlocked first. The handle 67 in the adjusting mechanism **60*b* is then operated to rotate the male threaded member 63. When the male threaded member 63 rotates, it moves in response to the screw action with the female threaded member 64. Subsequently, the movable sleeve 62, and the fifth and sixth gears 65, 66 rotatably arranged thereon through bearings, move along the spline shaft 61. In this case, the fifth gear 65 turns along the helical torsion of the follower gear 38 that is located at upstream of drive and secured to the fifth gear 65 by the driving force. Consequently, the sixth gear 66 integrally arranged with the fifth gear 65 also turns in the same manner. Similarly, the fourth gear 44 turns along the helical torsion of the sixth gear 66 that is located at upstream of drive and secured to the fourth gear 44 by the driving force. The fourth gear 44 makes an angular displacement after receiving an angular displacement of the fifth gear 65 relative to the follower gear 38 transmitted through the sixth gear 66 and adding its own angular displacement relative to the sixth gear 66. This angular displacement is transmitted to the third gear 43 through the gear mechanism sleeve 42 and employed to turn the first gear 49 and the second gear 59 mating with the third gear 43**.

When the first gear 49 turns, the first camshaft 45 turns relative to the third base 3, and the first eccentric cam 46 turns within the first slider 47 in which the first eccentric cam 46 is fitted. Consequently, the first eccentric cam 46 moves the first slider 47 in the radial direction of the first base 1 and exerts a force on the first base 1 in one direction parallel with the tangent to the rotational trail of the first base 1 through the first slider 47. Finally, the first base 1 turns about the rotational centerline of the third base 3 in one direction. When the second gear 59 turns, the second camshaft 55 turns relative to the third base 3, and the second eccentric cam 56 turns within the second slider 57 in which the second eccentric cam 56 is fitted. Consequently, the second eccentric cam 56 moves the second slider 57 in the radial direction of the second base 2 and exerts a force on the second base 2 in one direction parallel with the tangent to the rotational trail of the second base 2 through the second slider 57. Finally, the second base 2 turns about the rotational centerline of the third base 3 in the other direction. As a result, the stationary member 11 attached to the first base 1 and the swing member 21 attached to the second base 2 displace about the rotational centerline of the third base 3 in opposite directions to adjustably vary the gap between the jaw portions of both members. After completion of the adjustment, the lock mechanism 68 is employed to secure the male threaded member 63.

In the first force exerting mechanism 8, the compressible spring 82 housed in the case 83 pushes the first base 1 in one direction through the pusher 81 and the support 89 to exert a force on the first base 1. This force can rotate the first base 1 relative to the third base 3 clockwise in FIG. 6. In the second force exerting mechanism 9, the compressible spring 92 housed in the case 93 pushes the second base 2 in the opposite direction through the pusher 91 and the support 99 to exert a force on the second base 2. This force can rotate the second base 2 relative to the third base 3 counterclockwise in FIG. 6. The first force exerting mechanism 8 and the second force exerting mechanism 9 always exert opposite forces onto the first base 1 and the second base 2. In this case, a movable portion in the jaw clearance adjustment mechanism 4 is always pushed against one of corresponding portions by a fine clearance. As a result, fine clearances for movement in the circumferential direction about the rotational centerline of the third base 3 or in the direction of the gap between the jaw portions of the stationary and swing members 11, 21 can be always integrated in one direction. Therefore, during the adjustment, the fine clearances are not integrated in an unstable state.

In the jaw cylinder according to the first embodiment, in order to widen the gap between the stationary member 11 and the swing member 21, it is required to turn the first base 1 against the force of the compressible spring 82 in the first force exerting mechanism 8 and turn the second base 2 against the force of the compressible spring 92 in the second force exerting mechanism 9 by the same angle relative to the third base 3. In order to narrow the gap between the stationary member 11 and the swing member 21, it is required to turn the first base 1 following the force of the compressible spring 82 in the first force exerting mechanism 8 and turn the second base 2 following the force of the compressible spring 92 in the second force exerting mechanism 9 by the same angle relative to the third base 3. Therefore, accuracy is not lacked in an amount of adjustment. The pushers 81, 91 are arranged to contact with the supports 89, 99 if the gap between the jaw portions of the stationary member 11 and the swing member 21 is minimized.

During the operation of the jaw clearance adjusting mechanism 4, the repulsive mechanism 7 acts in between the follower gear 38 and the fourth gear 44. As the follower gear 38 is secured to the fourth gear 44 by the driving force, between the bracket 74 attached to the follower gear 38 and the shaft 71 provided in the fourth gear 44, a repulsive force from the compressible spring 73 located through the guide rod 72 acts on the fourth gear 44 through the guide rod 72, the bearing 75 and the shaft 71 to exert a force on the fourth gear 44 counterclockwise in FIG. 2. As a result, the fourth gear 44 turns about its rotational centerline (same as the rotational centerline of the follower gear 38) and always pushes its one tooth surface against the corresponding tooth surface of the sixth gear 66. When the fourth gear 44 pushes, the sixth gear 66 and the fifth gear 65 together with the sixth gear 66 turns about its rotational centerline. In this case, the fifth gear 65 always pushes its one tooth surface against the corresponding tooth surface of the follower gear 38 secured to the fourth gear 44 by the driving force. Therefore, backlash between the follower gear 38 and the fifth gear 65 and backlash between the sixth gear 66 and the fourth gear 44 can be removed and play rotations caused from the backlash during rotations of these gears can be blocked. This is effective to prevent an unstable integration of the fine clearances corresponding to the backlash during the jaw clearance adjustment without lacking accuracy in an amount of adjustment.

In the present invention, if either of the fifth gear 65 and the sixth gear 66 and a gear mating therewith comprise helical gears, a similar jaw clearance adjusting operation can be achieved. Alternatively, if both of the fifth gear 65 and the sixth gear 66 and gears mating therewith comprise helical gears, a similar jaw clearance adjusting operation can be achieved. In this case, the fifth gear 65 may have a different torsion angle from that of the sixth gear 66.

Figure 9:
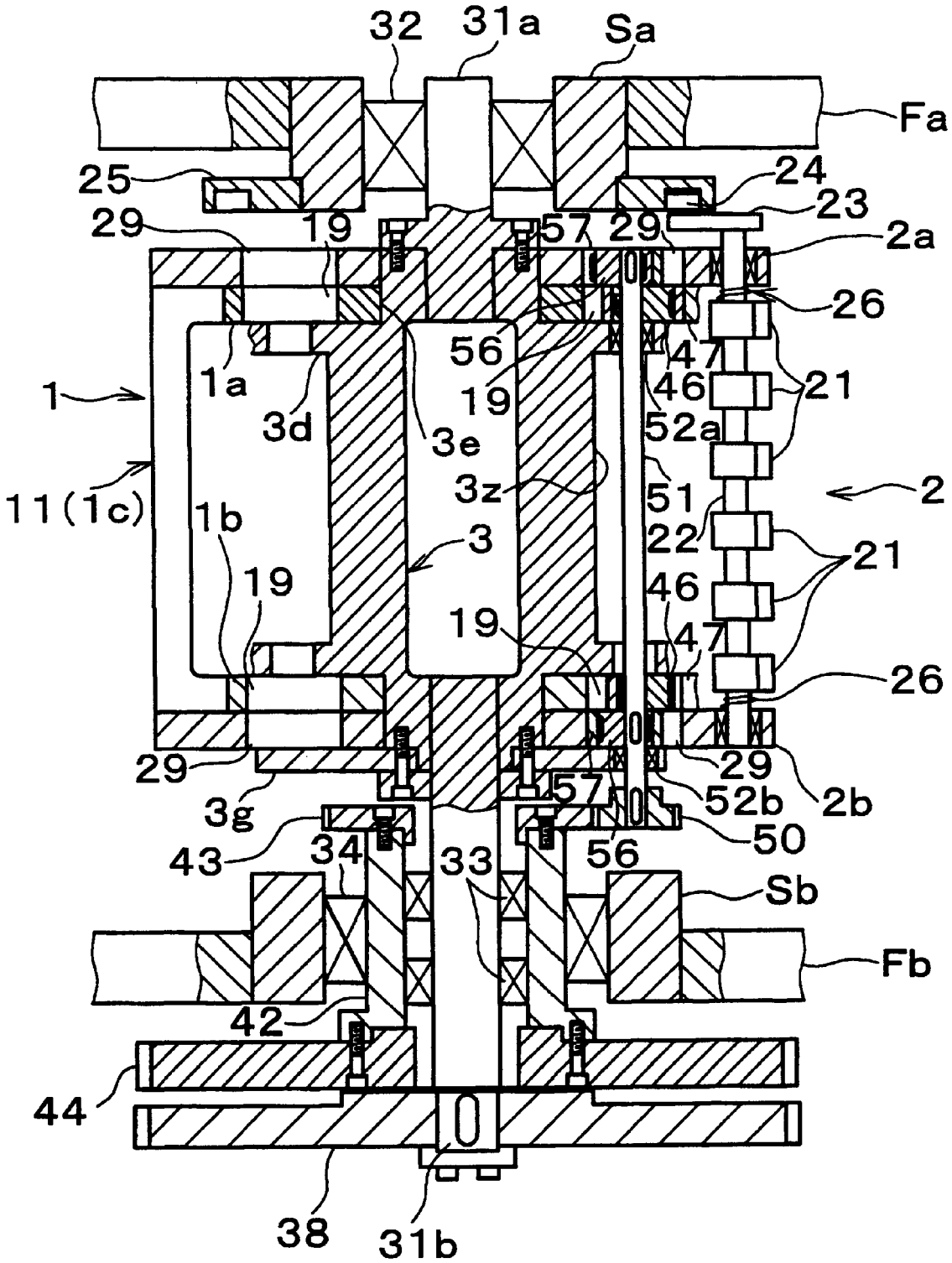
FIG. 9 a partial cross-sectional view showing a second embodiment of a jaw cylinder in a jaw folder according to the present invention, which is the same partial cross-sectional view as FIG. 1 except for omitting the portion along the Ib—Ib line in FIG. 2.

A second embodiment of a jaw cylinder in a jaw folder according to the present invention will be described next based on FIG. 9. As shown in FIG. 9, in a jaw clearance adjusting mechanism 4 according to the second embodiment, a camshaft 51 is rotatably supported through bearings 52*a*, 52*b* on the holder plate 3*g* and the rising portions 3*d*, . . . , 3*d* located at the opposite locations. First eccentric cams 46, 46 are provided rotatably together with the camshaft 51 at locations of the camshaft 51 corresponding to the notches 19 in the first plates 1*a*, 1*b*. First sliders 47 are rotatably fitted with the first eccentric cams 46 and mounted in the notches 19 movably only in the radial direction of the first plates 1*a*, 1*b*. A camshaft gear 50 is rotatably located together with the camshaft 51 at the tip of the camshaft 51 passed through the holder plate 3*g*. Second eccentric cams 56, 56 are provided rotatably together with the camshaft 51 at locations of the camshaft 51 corresponding to the notches 29 in the second plates 2*a*, 2*b*. Second sliders 57 are rotatably fitted with the second eccentric cams 56 and mounted in the notches 29 movably only in the radial direction of the second plates 2*a*, 2*b*. The first and second eccentric cams 46, 56 are arranged to turn the first and second bases 1, 2 about the rotational centerline of the third base 3 by an equal angle in opposite directions when the camshaft 51 turns through the third and camshaft gears 43, 50. The second embodiment is also provided with the same arrangements as those in the first embodiment shown in FIGS. 1–6, which include the arrangement of the camshaft gear 50 mating with third gear 43 attached at the other side of the gear mechanism sleeve 42 and located movably together with the gear mechanism sleeve 42; the arrangement of the fourth gear 44 located at one side of the gear mechanism sleeve 42 and located movably together with the gear mechanism sleeve 42; the arrangement of the fourth gear 44 having the same pitch circular diameter as that of the follower gear 38 and the opposite direction of torsion relative to that of the follower gear 38; and the arrangement of the jaw clearance adjusting mechanism 4 equipped with the transmission gear mechanism (omitted in FIG. 9). The second embodiment is also provided with the first and second force exerting mechanisms and the repulsive mechanism (not depicted in FIG. 9) in addition to the above transmission gear mechanism, which have the same specific arrangements as those of the first embodiment shown in FIGS. 1–6.

In the second embodiment shown in FIG. 9, when the camshaft 50 turns, the first eccentric cam 46 turns within the first slider 47 in which the first eccentric cam 46 is fitted. Consequently, the first eccentric cam 46 moves the first slider 47 in the radial direction of the first base 1 and exerts a force on the first base 1 in one direction parallel with the tangent to the rotational trail of the first base 1 through the first slider 47. Finally, the first base 1 turns about the rotational centerline of the third base 3 in one direction. At the same time, the second eccentric cam 56 turns within the second slider 57 in which the second eccentric cam 56 is fitted. Consequently, the second eccentric cam 56 moves the second slider 57 in the radial direction of the second base 2 and exerts a force on the second base 2 in one direction parallel with the tangent to the rotational trail of the second base 2 through the second slider 57. Finally, the second base 2 turns about the rotational centerline of the third base 3 in the other direction. As a result, the stationary member 11 attached to the first base 1 and the swing member 21 attached to the second base 2 displace about the rotational centerline of the third base 3 in opposite directions to adjustably vary the gap between the jaw portions of both members.

Arrangements of the first and second force exerting mechanisms 8, 9 are not limited in the above examples. For instance, the case 83 may be integrated with the case 93 to form a continuous hollow portion (not depicted), in which a single compressible spring (not depicted) is loaded. One end of the compressible spring is pressed against the tail of the pusher 81 for pushing the first stay 1*c* through the support 89. The other end of the compressible spring is pressed against the tail of the pusher 91 for pushing the second stay 2*c* through the support 99. In this arrangement, the single compressible spring loaded in the hollow portion is employed to exert forces to the pushers 81 and 91 in opposite directions.

As obvious from the forgoing, according to the jaw cylinder of the present invention, in movable linkers and couplers, that is, in gear-mating sections, coupling sections between male and female screws, and movable fitting sections, among members employed to form the mechanism for adjusting the gap between the stationary and swing members, fine clearances provided for movement can be integrated in a predetermined condition. Therefore, it is possible to determine these fine clearances correctly to adjust the gap between the stationary and swing members. It is possible to correctly set the gap between the jaw portions of the stationary and swing members. As a result, it is possible to prevent a print from dropping off to cause paper jamming in the jaw folder and disturbing a print rejection pitch. It is also possible to prevent a damaged print and an offset on adjacent pages caused from too strong grip. Therefore, it is possible to improve machine efficiency and prevent failed prints. Further, it is possible to improve a yield and reduce a running cost. These effects can be achieved regardless of the thickness of the print, though it is particularly effective in thin prints.

Having described the embodiments consistent with the invention, other embodiments and variations consistent with the invention will be apparent to those skilled in the art. Therefore, the invention should not be viewed as limited to the disclosed embodiments but rather should be viewed as limited only by the spirit and scope of the appended claims.

What is claimed is:

1. A jaw cylinder in a jaw folder, comprising:

a first base including a stationary member in a jaw mechanism, said stationary member having a jaw portion;

a second base including a swing member, said swing member having a jaw portion accessible to said jaw portion of said stationary member; and a third base having end axes at both ends, said third base rotatably supported by said end axes on a pair of opposite frames, said first base and said second base rotatably located on said third base about the rotational centerline of said third base, said first, second and third bases synchronously rotating to move said swing member close to and apart from said stationary member to grip a print therebetween, said jaw cylinder further comprising:

a jaw clearance adjusting mechanism for turning said first and second bases about the rotational centerline of said third base in opposite directions to adjust a gap between said jaw portion of said stationary member and said jaw portion of said swing member in said jaw mechanism;

a first force exerting mechanism for always exerting a force on said first base in the direction parallel with the tangent to a rotational trail of said first base; and a second force exerting mechanism for always exerting a force on said second base in the direction parallel with the tangent to a rotational trail of said second base.

2. The jaw cylinder according to claim 1, wherein said forces exerted from said first force exerting mechanism and said second force exerting mechanism direct oppositely.

3. The jaw cylinder according to claim 1, wherein said first force exerting mechanism and said second force exerting mechanism are arranged on said third base.

4. The jaw cylinder according to claim 1, wherein said first force exerting mechanism and said second force exerting mechanism are integrated and interposed between said first base and said second base.

5. The jaw cylinder according to claim 1, said jaw clearance adjusting mechanism including:

a first camshaft rotatably supported on said third base, and having a first eccentric cam located at a portion corresponding to said first base and a first gear located at a portion protruded from a side of said jaw cylinder to one of said frames;

a second camshaft rotatably supported on said third base, and having a second eccentric cam located at a portion corresponding to said second base and a second gear located at a portion protruded from a side of said jaw cylinder to said one of said frames;

a first slider fitted with said first eccentric cam and arranged on said first base only movable in the radial direction of said first base;

a second slider fitted with said second eccentric cam and arranged on said second base only movable in the radial direction of said second base;

a follower gear attached to a portion of said end axis of said third base protruded from said one of said frames and mated with a driver gear to transmit rotations to said third base;

a gear mechanism rotatably supported on said one of said frames about the rotational centerline of said third base, and having a fourth gear located at a portion protruded to one side of said one of said frames and a third gear located at a portion protruded to the other side of said one of said frames, said third gear mating with said first gear and said second gear simultaneously;

a transmission gear mechanism having a fifth gear mating with said follower gear and a sixth gear mating with said fourth gear, said fifth and sixth gears located integrally and rotatably about the same rotational centerline and movable in the direction parallel with the rotational centerline, at least one of said fifth and sixth gears and a gear mating therewith consisting of helical gears; and an adjusting mechanism for displacing said transmission gear mechanism in the direction parallel with said rotational centerline thereof.

6. The jaw cylinder according to claim 5, wherein said fifth gear and said sixth gear both consist of helical gears located at different torsion angles and/or torsion directions.

7. The jaw cylinder according to claim 5, further comprising a repulsive mechanism interposed between said follower gear and said fourth gear, said repulsive mechanism always exerting a force on an eccentric location of said follower gear in one direction parallel with said tangent to said rotational trail of said follower gear, and always exerting a force on an eccentric location of said fourth gear in the direction opposite to said one direction parallel with said tangent to said rotational trail of said follower gear.

8. The jaw cylinder according to claim 1, said jaw clearance adjusting mechanism including:

a camshaft rotatably supported on said third base, and having a first eccentric cam located at a portion corresponding to said first base, a second eccentric cam located at a portion corresponding to said second base and a camshaft gear located at a portion protruded from a side of said jaw cylinder to one of said frames;

a first slider fitted with said first eccentric cam and arranged on said first base only movable in the radial direction of said first base;

a second slider fitted with said second eccentric cam and arranged on said second base only movable in the radial direction of said second base;

a follower gear attached to a portion of said end axis of said third base protruded from said one of said frames and mated with a driver gear to transmit rotations to said third base;

a gear mechanism rotatably supported on said one of said frames about the rotational centerline of said third base and having a fourth gear located at a portion protruded to one side of said one of said frames, and a third gear located at a portion protruded to the other side of said one of said frames, said third gear mating with said camshaft gear;

a transmission gear mechanism having a fifth gear mating with said follower gear and a sixth gear mating with said fourth gear, said fifth and sixth gears located integrally and rotatably about the same rotational centerline and movable in the direction parallel with the rotational centerline, at least one of said fifth and sixth gears and a gear mating therewith consisting of helical gears; and an adjusting mechanism for displacing said transmission gear mechanism in the direction parallel with said rotational centerline thereof.

9. The jaw cylinder according to claim 8, wherein said fifth gear and said sixth gear both consist of helical gears located at different torsion angles and/or torsion directions.

10. The jaw cylinder according to claim 8, further comprising a repulsive mechanism interposed between said follower gear and said fourth gear, said repulsive mechanism always exerting a force on an eccentric location of said follower gear in one direction parallel with said tangent to said rotational trail of said follower gear, and always exerting a force on an eccentric location of said fourth gear in the direction opposite to said one direction parallel with said tangent to said rotational trail of said follower gear.

* * * * *